US009873188B1

(12) United States Patent
Chen

(10) Patent No.: US 9,873,188 B1
(45) Date of Patent: Jan. 23, 2018

(54) PLIERS FOR LOOP CLAMP

(71) Applicant: JOINWIN CO., LTD., Taichung (TW)

(72) Inventor: Hsiao-Hsiang Chen, Taichung (TW)

(73) Assignee: Joinwin Co., Ltd., Taichung (TW)

( * ) Notice: Subject to any disclaimer, the term of this patent is extended or adjusted under 35 U.S.C. 154(b) by 0 days.

(21) Appl. No.: 15/211,473

(22) Filed: Jul. 15, 2016

(51) Int. Cl.
*B25B 27/14* (2006.01)
*B25B 27/30* (2006.01)

(52) U.S. Cl.
CPC ..... *B25B 27/146* (2013.01); *B25B 27/30* (2013.01)

(58) Field of Classification Search
USPC ..... 29/235, 252, 278; 81/9.3, 314, 367, 403, 81/426.5
See application file for complete search history.

(56) References Cited

U.S. PATENT DOCUMENTS 1,967,960 A * 7/1934 McNemar ..... B67B 7/18 7/151
2,464,472 A * 3/1949 Ward ..... B25B 7/123 81/367
3,223,133 A * 12/1965 Brookey ..... A47J 43/26 241/101.1
9,180,576 B2 * 11/2015 Wu ..... B25B 7/02

FOREIGN PATENT DOCUMENTS

| | | |
|---|---|---|
| TW | M307500 | 3/2007 |
| TW | M328357 | 3/2008 |
| TW | M376397 | 3/2010 |

* cited by examiner

*Primary Examiner* — Joseph J Hail
*Assistant Examiner* — Shantese McDonald
(74) *Attorney, Agent, or Firm* — Muncy, Geissler, Olds & Lowe, P.C.

(57) ABSTRACT

A pliers for a loop clamp is provided, including a grip assembly, a displacement mechanism and a clamping assembly. The grip assembly has two handle members which are pivotally assembled with each other. The displacement mechanism is movably connected to the grip assembly, and the displacement mechanism can be actuated by the grip assembly. The clamping assembly has two clamping portions for clamping two ends of a loop clamp, the two clamping portions are connected with the grip assembly, and at least one of the two clamping portions is movably connected to the grip assembly and can be actuated by the displacement mechanism to change a distance between the two clamping portions.

6 Claims, 6 Drawing Sheets

PLIERS FOR LOOP CLAMP

BACKGROUND OF THE INVENTION

Field of the Invention

The present invention relates to a pliers for a loop clamp.

Description of the Prior Art

There are many types of loop clamp removal tools, one of which actuates two clamping portions with a steel wire to clamp a loop clamp tightly; however, a structure of this type of tool is more complex, and it is uneasy to be assembled and put away. Therefore, the two clamping portions are often assembled to a grip portion to be in a pliers shape, and a user can grip the grip portion and clamp two ends of the loop clamp directly. It is convenient, fast and logical for the user to use the loop clamp removal tool. This type of loop clamp removal tools are disclosed in TWM307500, TWM328357 and TWM376397.

However, in this type of prior art, a distance between the two clamping portions cannot be fixed, so when the user wants to clamp the two ends of the loop clamp, the user has to reopen the two clamping portions to a width corresponding to a width of the loop clamp to conduct a removal operation. When there are many loop clamps in similar dimensions needed to be removed, it takes longer time to remove the loop clamps and may cause burden to hands of the user. In addition, in this type of prior art, an opening range of the two clamping portions is limited, and the two clamping portions cannot be opened wider; therefore, when the loop clamp has a greater dimension, it is inconvenient and cost-consuming that the user has to find other proper tools to remove the loop clamp.

The present invention has arisen to mitigate and/or obviate the afore-described disadvantages.

SUMMARY OF THE INVENTION

The major object of the present invention is to provide a pliers for a loop clamp which can adjust a distance between two clamping portions in accordance with a distance between two ends of a loop clamp to be clamped. The pliers for the loop clamp is easy to use. In addition, when a removal operation is conducted repeatedly and quantitatively, the two clamping portions can be positioned in a fixed distance; therefore, a user does not have to repeat actions of opening, closing and adjusting the two clamping portions, and hands of the user can be protected, a working efficiency is elevated, and a working time is saved.

To achieve the above and other objects, a pliers for a loop clamp is provided, including a grip assembly, a displacement mechanism and a clamping assembly. The grip assembly has two handle members which are pivotally assembled with each other. The displacement mechanism is movably connected to the grip assembly, and the displacement mechanism can be actuated by the grip assembly. The clamping assembly has two clamping portions for clamping two ends of a loop clamp, the two clamping portions are connected with the grip assembly, and at least one of the two clamping portions is movably connected to the grip assembly and can be actuated by the displacement mechanism to change a distance between the two clamping portions.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
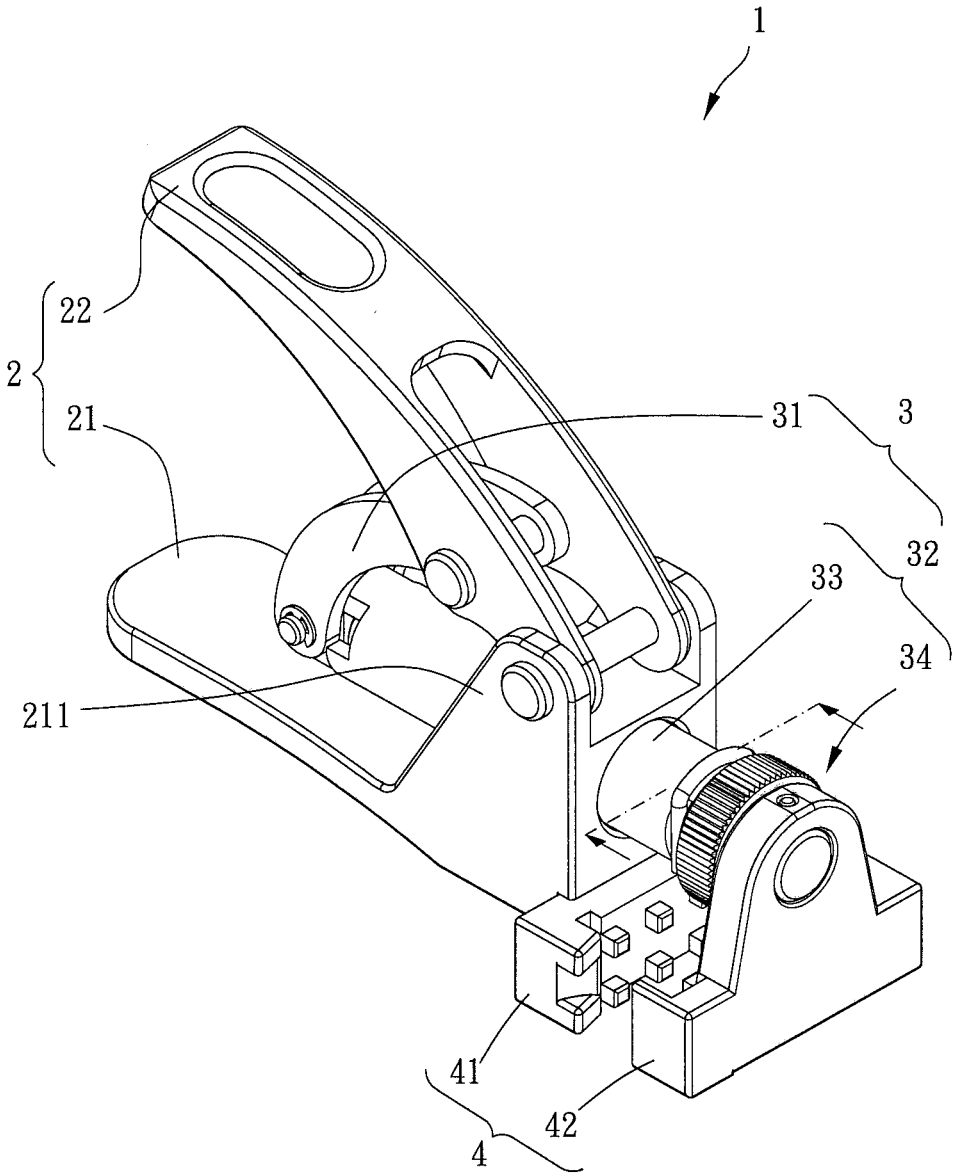
FIG. 1 is a stereogram of a preferred embodiment of the present invention.
Figure 2:
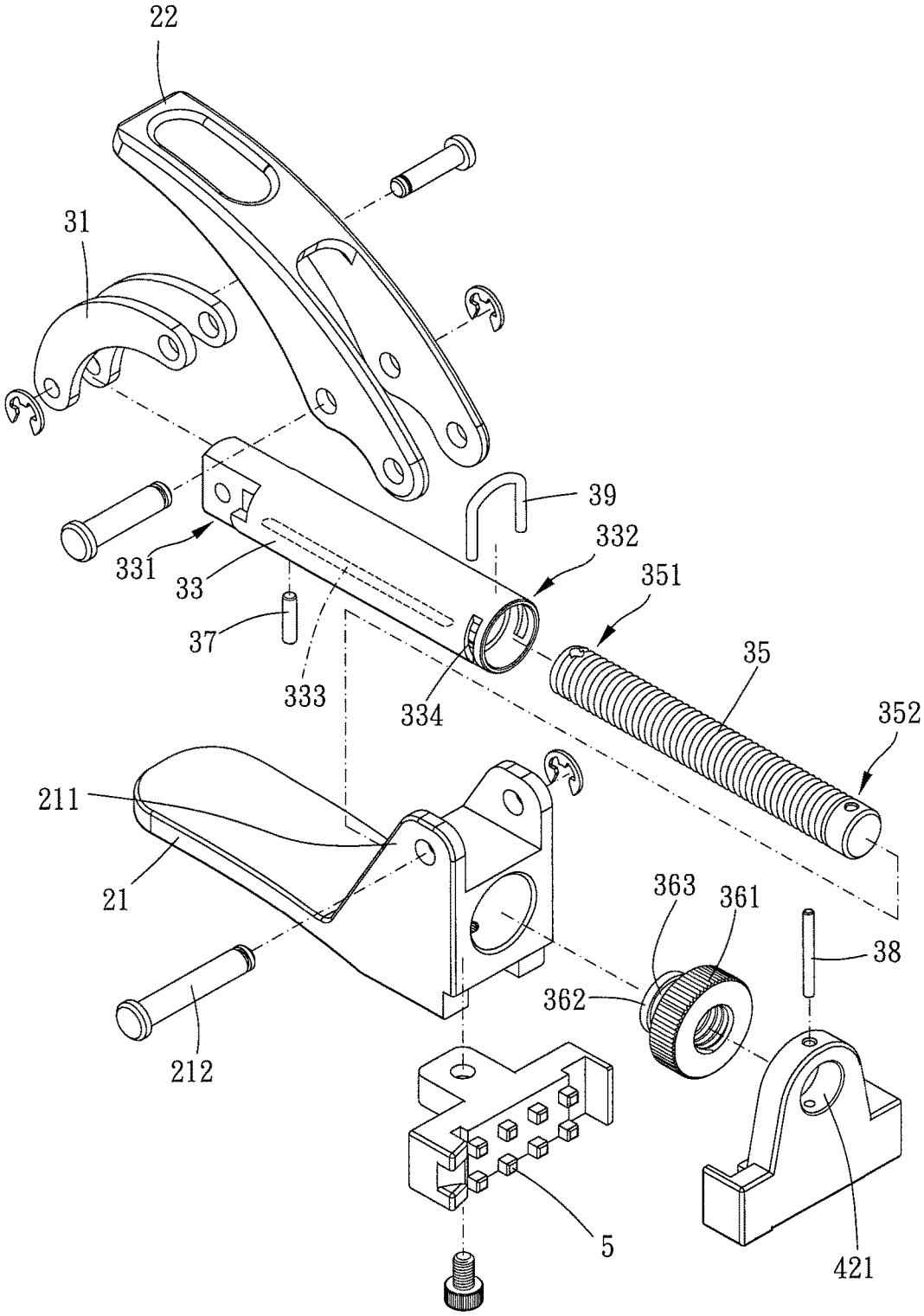
FIG. 2 is a breakdown view of the preferred embodiment of the present invention.
Figure 3:
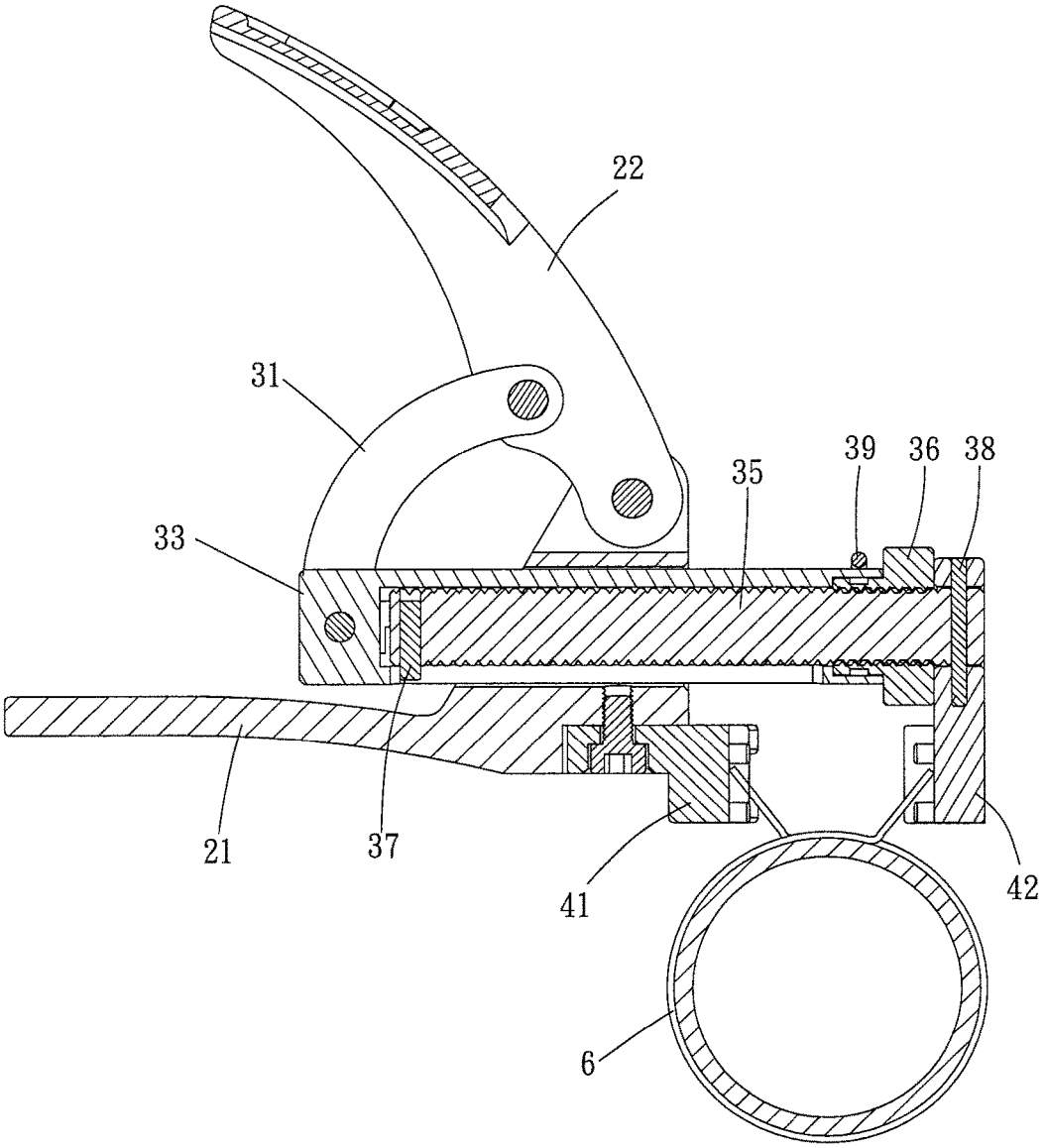
FIGS. 3 and 4 are drawings showing the preferred embodiment of the present invention in operation.
Figure 4:
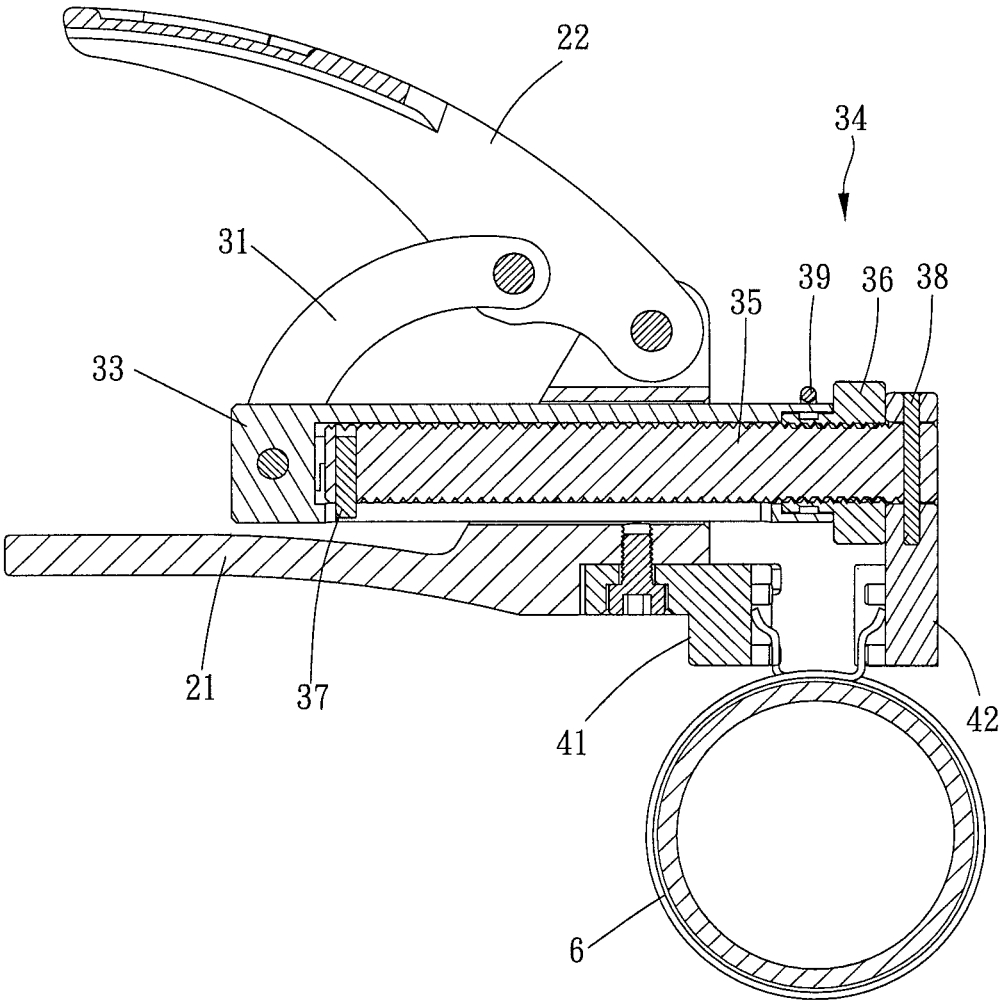
Figure 5:
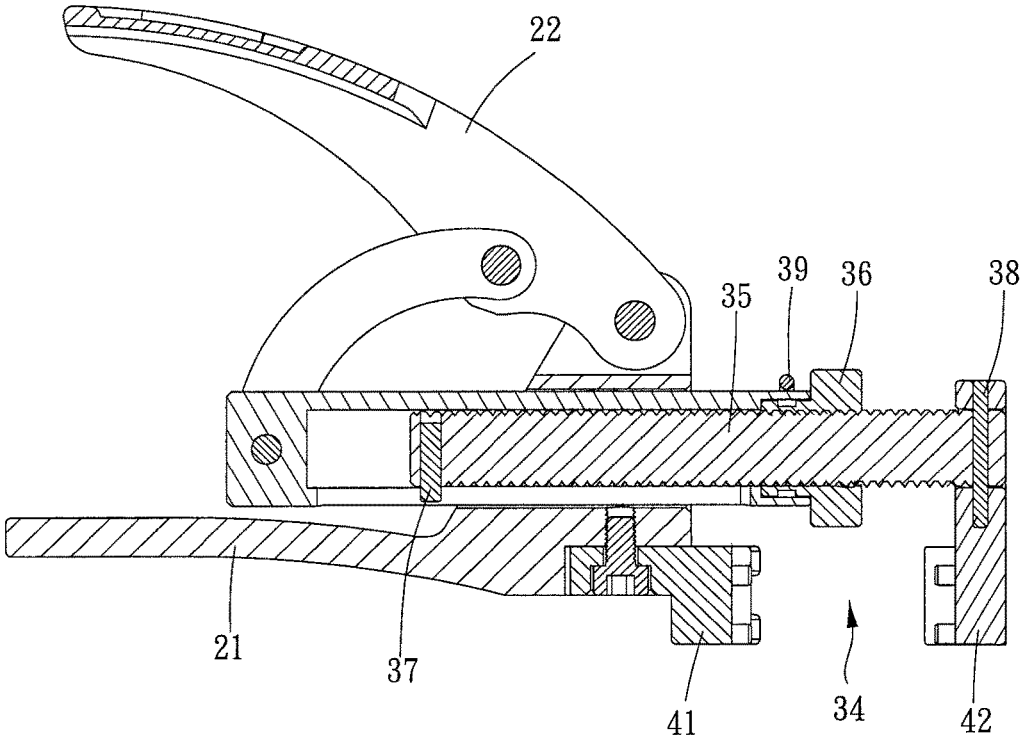
FIG. 5 is a cross-sectional view of the preferred embodiment of the present invention.
Figure 6:
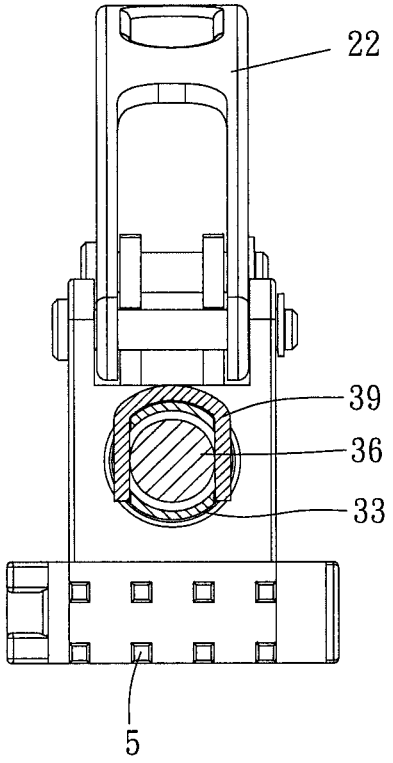
FIG. 6 is another cross-sectional view of the preferred embodiment of the present invention.

Please refer to FIGS. 1 to 6 for a preferred embodiment of the present invention. A pliers for a loop clamp 1 includes a grip assembly 2, a displacement mechanism 3 and a clamping assembly 4.

The grip assembly 2 has two handle members which are pivotally assembled with each other. The displacement mechanism 3 is movably connected to the grip assembly 2, and the displacement mechanism 3 can be actuated by the grip assembly 2. The clamping assembly 4 has two clamping portions for clamping two ends of a loop clamp 6, the two clamping portions are connected with the grip assembly 2, and at least one of the two clamping portions is movably connected to the grip assembly 2 and can be actuated by the displacement mechanism 3 to change a distance between the two clamping portions. In other words, one of the two clamping portions may move toward or away from the other of the two clamping portions; or the two clamping portions may move toward or away from each other simultaneously.

In this embodiment, the two handle members are respectively a first handle member 21 and a second handle member 22, the two clamping portions are respectively a first clamping portion 41 and a second clamping portion 42, the first clamping portion 41 is fixedly connected to the first handle member 21, and the second clamping portion 42 is connected to the displacement mechanism 3 and connected to the grip assembly 2. It is to be noted that the first and second clamping portions 41, 42 are respectively detachably connected to the first handle member 21 and the displacement mechanism 3, and when the first and second clamping portions 41, 42 are damaged, the user can replace the first and second clamping portions 41, 42 directly instead of replacing the whole pliers for the loop clamp 1. In actual practice, the displacement mechanism 3 drives the second clamping portion 42 to move toward the first clamping portion 41 to clamp the two ends of the loop clamp 6. Preferably, a working face of the first clamping portion 41 and a working face of the second clamping portion 42 opposite to each other are respectively provided with a plurality of protrusions 5 arranged in intervals, and each said protrusion 5 is for abutting against an end of the loop clamp 6. Specifically, a distance between either two of the protrusions 5 neighboring to each other is for an end of the loop clamp 6 to project therein to abut against each said protrusion 5 laterally so that the two ends of the loop clamp 6 will not easily loose during a clamping process.

More specifically, the displacement assembly 3 includes a connecting member 31 and a displacement assembly 32, the second clamping portion 42 is connected to the displacement assembly 32, two ends of the connecting member 31 are respectively connected to the displacement assembly 32 and the second handle member 22, when the second handle member 22 approaches the first handle member 21, the connecting member 31 actuates the displacement assembly 32 to move along a first direction to drive the second clamping portion 42 to move toward the first clamping portion 41, and the first direction is transverse to swinging directions of the two handle members. Specifically, the displacement assembly 32 includes a main body 33 and an adjustment assembly 34, the adjustment assembly 34 is assembled on a second end 332 of the main body 33, the adjustment assembly 34 is retractable and positionable relative to the main body 33, and the second clamping portion 42 is connected to the adjustment assembly 34 so that the user can adjust the distance between the first and second clamping portions 41, 42 according to a dimension o the loop clamp 6 to be clamped. In addition, please further refer to FIG. 5. When there is a large quantity of the loop clamps 6 in a same dimension needed to be removed, the user only needs to adjust the distance between the first and second clamping portions 41, 42 when clamping the loop clamp 6 for the first time, and then the second clamping portion 42 is positioned on a predetermined position so that the user can clamp the two ends of other said loop clamps 6 with the first and second clamping portions 41, 42 directly without adjusting the distance between the first and second clamping portions 41, 42 again. Besides, compared with a normal clamping way of a pliers, the pliers for the loop clamp 1 can reduce a burden to hands of the user by decreasing a number of opening and closing the hand. In this embodiment, the main body 33 has a first end 331 and the second end 332, one of the two ends of the connecting member 31 is pivoted to the first end 331, the other end of the two ends of the connecting member 31 is pivoted to the second handle member 22, and the grip assembly 2 can smoothly and quickly actuate the displacement assembly 32 via a pivoting design. In other embodiments, the connecting member 31 may abut against the displacement assembly 32 to actuate the displacement assembly 32.

Specifically, the adjustment assembly 34 includes a threaded rod 35 and an adjustment member 36 screwed with the threaded rod 35, the adjustment member 36 is rotatably connected to the second end 332 of the main body 33, a third end 351 of the threaded rod 35 is movably arranged in an interior of the main body 33, a fourth end 352 of the threaded rod 35 is disposed through the adjustment member 36 to be assembled to the second clamping portion 42, and the adjustment member 36 is located between the main body 33 and the second clamping portion 42. Through rotating the adjustment member 36, the threaded rod 35 can be quickly controlled to retract relative to the main body 33, and a distance between the threaded rod 35 and the main body 33 can be adjusted continuously and subtly through screwing. Please refer to FIGS. 2 and 6 for a more detailed description of an assembling way of the adjustment member 36 and the main body 33. The adjustment assembly 36 further includes an assembling member 39, the adjustment member 36 further includes a body portion 361 and a head portion 362 projecting into an interior of the second end 332, a ring portion 363 is recessed around the head portion 362, an circumference of the second end 332 of the main body 33 has two openings 334 opposite to the ring portion 363, and when the adjustment member 36 is assembled to the second end 332, the assembling member 39 is disposed through each said opening 334 and engaged with the ring portion 363. However, the adjustment assembly 34 may be in other cooperation modes. For example, in other embodiments, the threaded rod 35 may be a rod member having a positioning ball, the second end 332 of the main body 33 may have a plurality of through holes in intervals which are optionally engaged with the positioning ball, and the main body 33 is retracted and positioned via the through holes on different positions.

In this embodiment, the first handle member 21 further has two ear portions 211 which extend along a direction substantially perpendicular to the first direction and a pivot member 212, the pivot member 212 is inserted through the two ear portions 211 and the second handle member 22 so that the second handle member 22 is pivotable relative to the two ear portions 211. The main body 33 is located between the first and second handle members 21, 22, the second end 332 of the main body 33 is slidably disposed through the first handle member 21 along the first direction, when the second handle member 22 swings toward the first handle member 21, and the second handle member 22 pushes the connecting member 31, pulls the main body 33 and drives the second clamping portion 42 to move toward the grip assembly 2. In other words, the grip assembly 2 moves the second clamping portion 42 through linkage. Preferably, the adjustment assembly 34 further includes a slidable member 37, the main body 33 has a sliding slot 333 extending along the first direction, an end of the slidable member 37 is assembled on the third end 351 of the threaded rod 35, and the other end of the slidable member 37 is slidably arranged in the sliding slot 333. The slidable member 37 can ensure that the third end 351 of the threaded rod 35 in the main body 33 does not collide or abrade with an inner wall of the main body 33 due to shaking so that an assembling stability of the threaded rod 35 and the main body 33 can be elevated. Preferably, the adjustment assembly 34 further includes a fixing member 38, and the second clamping portion 42 has an assembling opening 421, the fourth end 352 of the threaded rod 35 is disposed through the assembling opening 421, and the fixing member 38 is inserted in the second clamping portion 42 and the fourth end 352 to be fixedly connected to the second clamping portion 42 and the fourth end 352. Therefore, it is convenient for the user to assemble the second clamping portion 42 to the threaded rod 35 to have a more stable structure.

Given the above, the two clamping portions of the pliers for the loop clamp can be adjusted to cooperate with the loop clamps in different dimensions. The adjustment assembly can be adjusted to retract continuously and subtly through screwing.

In addition, when there is a large quantity of the loop clamps in a same dimension needed to be removed, the two clamping portions can be positioned in a fixed distance; therefore, a user does not have to repeat actions of opening, closing and adjusting the two clamping portions, and the hands of the user can be protected, a working efficiency is elevated, and a working time is saved.

In addition, the working face of the first clamping portion and the working face of the second clamping portion opposite to each other are respectively provided with the plurality of protrusions connected in intervals, the two ends of the loop clamp can respectively project therein to abut against each said protrusion laterally so as to elevate the stability.

While we have shown and described various embodiments in accordance with the present invention, it should be clear to those skilled in the art that further embodiments may be made without departing from the scope of the present invention.

What is claimed is:

1. A pliers for a loop clamp, including:

a grip assembly, having two handle members which are pivotally assembled with each other;

a displacement mechanism, movably connected to the grip assembly, the displacement mechanism being actuatable by the grip assembly;

a clamping assembly, having two clamping portions for clamping two ends of a loop clamp, the two clamping portions connected with the grip assembly, at least one of the two clamping portions movably connected to the grip assembly and being actuatable by the displacement mechanism to change a distance between the two clamping portions;

wherein the two handle members are respectively a first handle member and a second handle member, the two clamping portions are respectively a first clamping portion and a second clamping portion, the first clamping portion is fixedly connected to the first handle member, and the second clamping portion is connected to the displacement mechanism and connected to the grip assembly wherein the displacement mechanism includes a connecting member and a displacement assembly, the second clamping portion is connected to the displacement assembly, two ends of the connecting member are respectively connected to the displacement assembly and the second handle member, when the second handle member approaches the first handle member, the connecting member actuates the displacement assembly to move along a first direction to drive the second clamping portion to move toward the first clamping portion, and the first direction is transverse to swinging directions of the two handle members wherein the displacement assembly includes a main body and an adjustment assembly, the main body has a first end and a second end, the adjustment assembly is assembled on the second end of the main body, the adjustment assembly is retractable and positionable relative to the main body, the second clamping portion is connected to the adjustment assembly, one of the two ends of the connecting member is pivoted to the first end, and the other end of the two ends of the connecting member is pivoted to the second handle member.

2. The pliers for the loop clamp of claim 1, wherein the adjustment assembly includes a threaded rod and an adjustment member screwed with the threaded rod, wherein the adjustment member is rotatably connected to the second end of the main body, a third end of the threaded rod is movably arranged in an interior of the main body, a fourth end of the threaded rod is disposed through the adjustment member to be assembled to the second clamping portion, and the adjustment member is located between the main body and the second clamping portion.

3. The pliers for the loop clamp of claim 2, wherein the adjustment assembly further includes a slidable member, the main body has a sliding slot extending along the first direction, an end of the slidable member is assembled on the third end of the threaded rod, and the other end of the slidable member is slidably arranged in the sliding slot.

4. The pliers for the loop clamp of claim 2, wherein the adjustment assembly further includes an assembling member, the adjustment member further includes a body portion and a head portion projecting into an interior of the second end, a ring portion is recessed around the head portion, an circumference of the second end of the main body has two openings opposite to the ring portion, and when the adjustment member is assembled to the second end of the main body, the assembling member is disposed through each said opening and engaged with the ring portion.

5. The pliers for the loop clamp of claim 4, wherein the first handle member further has two ear portions which extend along a direction substantially perpendicular to the first direction and a pivot member, the pivot member is inserted through the two ear portions and the second handle member so that the second handle member is pivotable relative to the two ear portions, the main body is located between the first and second handle members, the second end of the main body is slidably disposed through the first handle member along the first direction, when the second handle member swings toward the first handle member, the second handle member pushes the connecting member, pulls the main body and drives the second clamping portion to move toward the grip assembly; the adjustment assembly further includes a slidable member and a fixing member, the main body has a sliding slot extending along the first direction, an end of the slidable member is assembled on the third end of the threaded rod, the other end of the slidable member is slidably arranged in the sliding slot, the second clamping portion has an assembling opening, the fourth end of the threaded rod is disposed through the assembling opening, and the fixing member is inserted in the second clamping portion and the fourth end to be fixedly connected to the second clamping portion and the fourth end.

6. The pliers for the loop clamp of claim 1, wherein a working face of the first clamping portion and a working face of the second clamping portion opposite to each other are respectively provided with a plurality of protrusions arranged in intervals, and each said protrusion is for abutting against an end of the loop clamp.

* * * * *